United States Patent [19]

Wasserman

[11] 4,031,688

[45] June 28, 1977

[54] TECHNIQUE FOR PRESSURIZING A SEALED ARTICLE

[76] Inventor: George J. Wasserman, 110 Babcock St., Brookline, Mass. 02146

[22] Filed: Sept. 4, 1975

[21] Appl. No.: 610,128

[52] U.S. Cl. ..... 53/7; 53/79; 81/15.2; 141/329; 273/61 D

[51] Int. Cl.[2] ..... B65B 31/08

[58] Field of Search ..... 53/7, 22 R, 79, 88, 53/112 R, 43; 152/370, 415; 141/329; 273/61 D

[56] References Cited

UNITED STATES PATENTS

| | | | |
|---|---|---|---|
| 3,921,977 | 11/1975 | Brink | 273/61 D |
| 3,932,977 | 1/1976 | Ringler | 53/7 |

*Primary Examiner*—Travis S. McGehee
*Attorney, Agent, or Firm*—Wolf, Greenfield & Sacks

[57] ABSTRACT

A technique for controlling the pressure in a closed, sealed article, such as a tennis ball or the like. A needle having a sharp, forward, outer end adapted to puncture the article includes a passage in its rear end which terminates in a flow orifice which opens through the side of the needle, between the ends of the needle. Means are provided at the outer end of the needle to carry a resilient sealing plug. The needle may be attached to a syringe or other appropriate means for injecting or withdrawing air from the article. The article is punctured by the plug-carrying needle which is inserted to expose the flow orifice interiorly of the article and to locate the plug within the article. Air is introduced or withdrawn from the article as desired. When the desired pressure level is reached, the needle is withdrawn. The needle and plug are arranged so that as the needle is withdrawn, the wall of the article engages the plug frictionally to hold it in the hole and effect a seal after the needle is completely withdrawn.

23 Claims, 14 Drawing Figures

FIG. 1
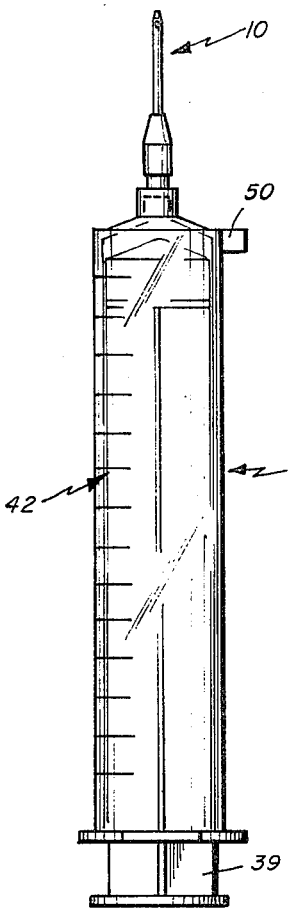
FIG. 2
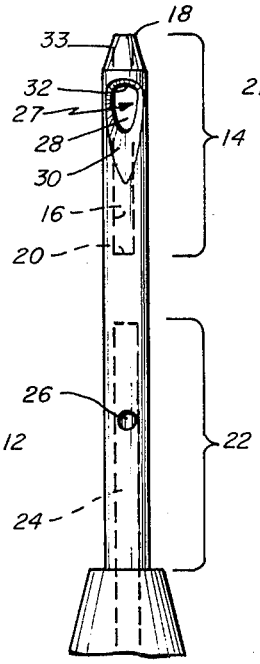
FIG. 3
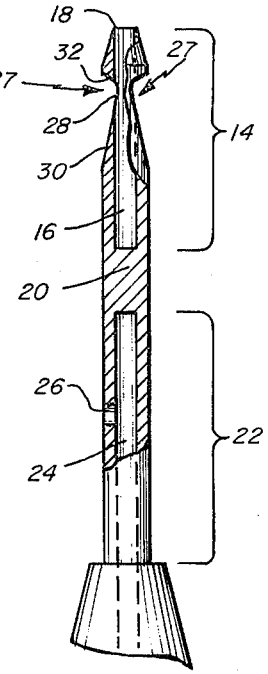
FIG. 4 FIG. 4A
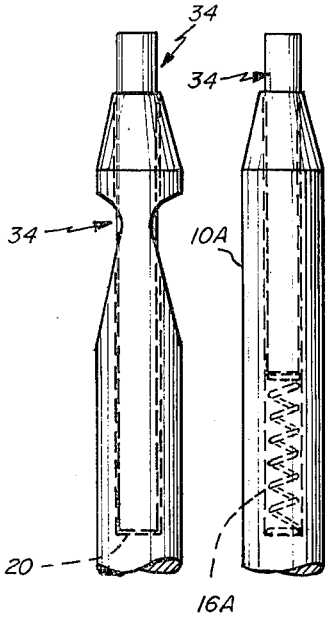
FIG. 6
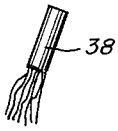
FIG. 7
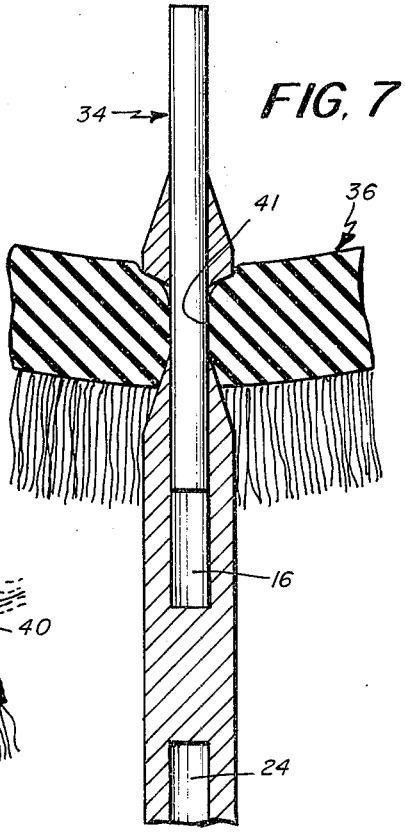
FIG. 5
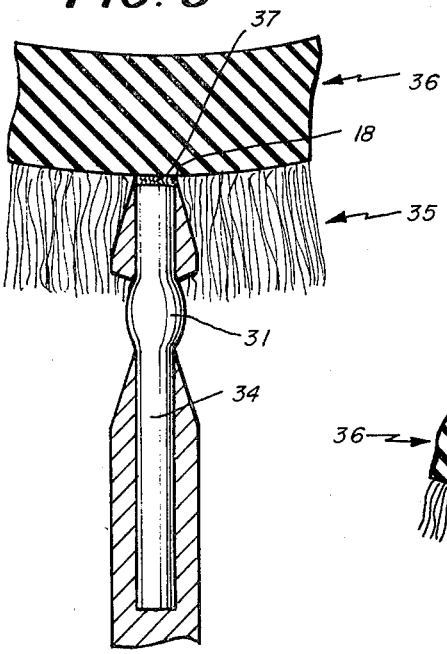
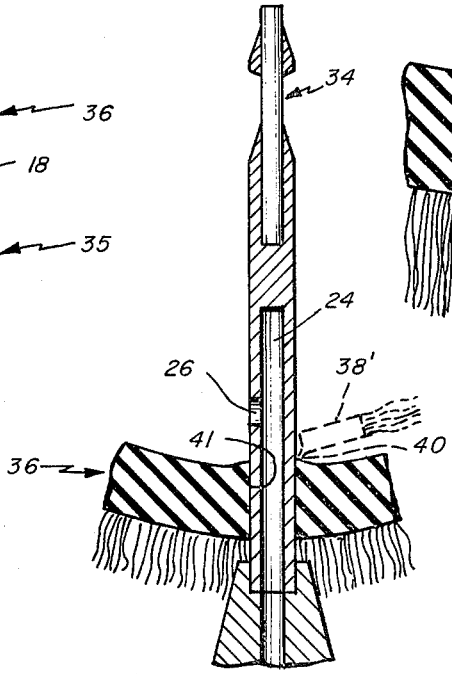

FIG. 8
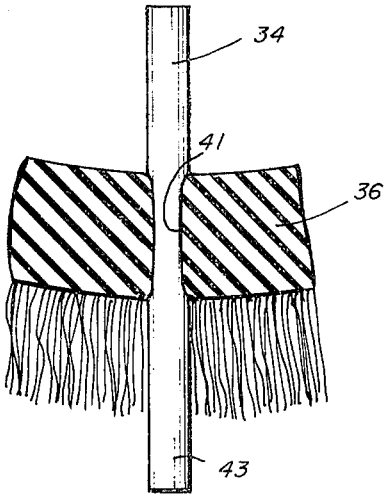
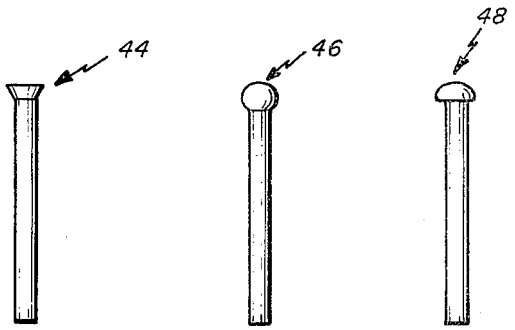
FIG. 9A FIG. 9B FIG. 9C
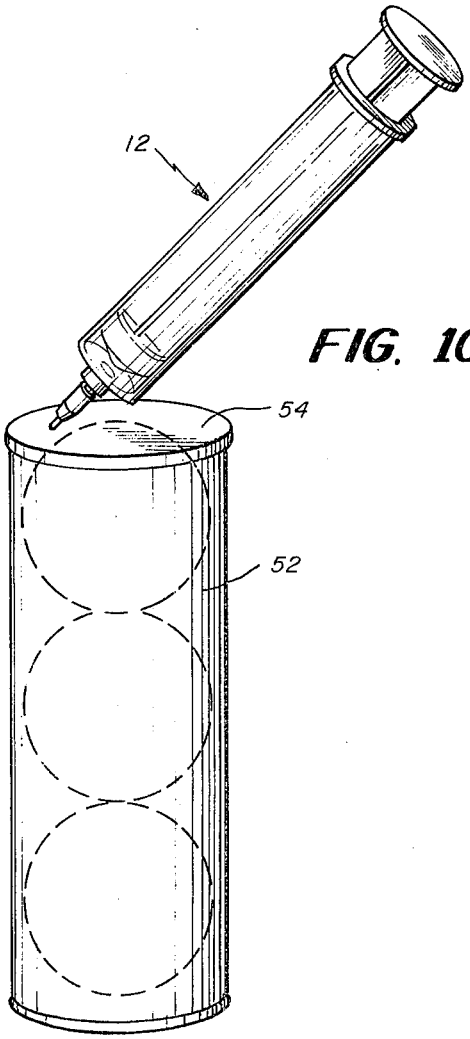
FIG. 10
FIG. 11
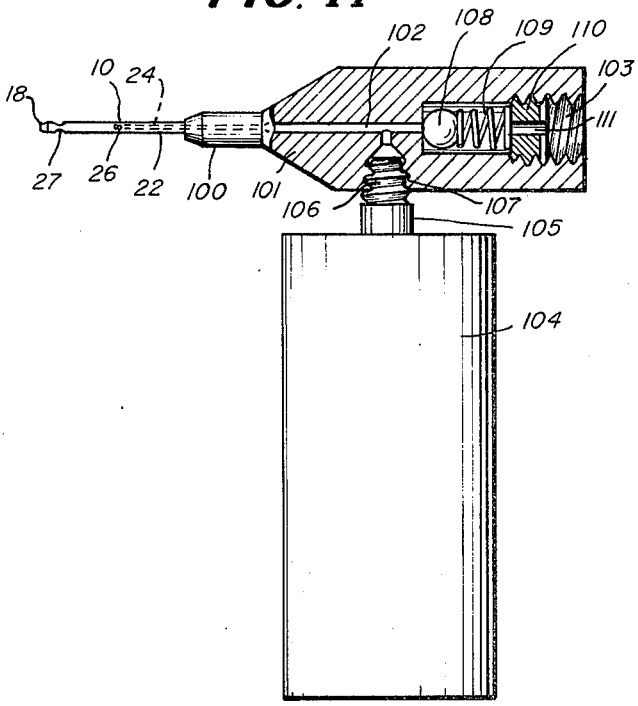

TECHNIQUE FOR PRESSURIZING A SEALED ARTICLE

BACKGROUND OF THE INVENTION

This invention relates to a method and apparatus for pressurizing closed, sealed articles, for example, tennis balls. It is important in the playing of tennis to use balls which are of uniform and regular characteristics. Among the many of such characteristics are the resilience and size of the ball which are partly dependent on the internal pressure of the ball. For example, a lower internal ball pressure will reduce the bounce of the ball while a higher pressure will increase its bounce and also may tend to enlarge the diameter of the ball slightly, but noticeably, particularly when in play. Changes from the desired internal pressure (approximately 15 p.s.i.) can result from a number of causes, perhaps the most common being repetitive use. Additionally, changes in atmospheric conditions (e.g., pressure or temperature) also can affect these characteristics of the ball. And where there is little change in atmospheric condition, prolonged shelving of the ball, even in stable atmospheric conditions, tends to result in a ball with reduced bounce and less liveliness.

Typically, tennis balls are packaged at the factory in hermetically sealed cans under pressure in an effort to increase the shelf life of the balls and to maintain them in a "lively condition" until ready for use. Even then, however, once the can has been opened and the pressure released, the useful life of the ball is relatively short, particularly after the balls have been used for a few games.

The most common difficulty encountered with tennis balls is that they lose their liveliness because of reduced internal pressure or weakening of the wall of the ball. There also are instances in which the ball has too much internal pressure, for example, as when the ball is brought to a location which is at a relatively high altitude. There the reduced atmospheric pressure results in an increased pressure differential between the inside and the outside of the ball which will tend to increase the liveliness beyond that which is normally expected and will also tend to increase the size of the ball slightly which has a noticeable effect on the response of the ball in play.

SUMMARY OF THE INVENTION

In accordance with the invention, a needle is employed to puncture the wall of closed containers such as a ball or like article. The outer end of the needle carries with it a resilient plug of rubber or similar material. The needle (which may be mounted to a syringe) also includes an air passage through its rear portion which opens through the side of the needle at a flow orifice. The ball is punctured by the needle which is inserted until the orifice is located inside the ball, the plug being held within the ball by the needle. Air then is injected into or withdrawn from the ball until the desired pressure level has been reached. The needle is then withdrawn. The needle construction is such that as it is withdrawn, the resilient plug is frictionally engaged by the wall and fills the puncture hole where it is gripped firmly by the wall contracts about the plug to seal the puncture hole.

The syringe may be graduated to control the pressure applied to or taken from the ball. Additionally, the syringe may have a valving arrangement formed therein to automatically limit the maximum pressure which can be applied to the interior of the ball or other article being pressurized.

While an important feature of the invention resides in its ability to rejuvenate or otherwise control the liveliness of tennis balls, the invention also may be employed in the manufacture of such balls. In this regard, it may be noted that tennis balls typically are manufactured using complicated controls and equipment. The present invention enables balls to be molded and assembled under atmospheric conditions and, after assembly, they can be pressurized utilizing the technique of the invention.

A further object of this invention is to provide a means and method by which I.L.T.A. or U.S.T.A. standards of relative tennis ball pressures may be attained regardless of the particular altitude at which the ball is used. In this connection, it may be noted that tennis balls are normally pressurized to a I.L.T.A. or U.S.T.A. standardized pressure at a particular level (e.g., sea level). However, the relative pressure will vary when the balls are shipped to locations at different altitudes (e.g., Denver). This, of course, means the standards will not be maintained in ordinary tennis balls.

It is among the primary objects of the invention to provide an improved technique for increasing or decreasing the internal pressure of a ball or other sealed, hollow article.

The invention also may be employed to pressure cans (for example, cans containing coffee) by fabricating the can so that part of it such as, for example, the lid is made of a material that is capable of being punctured and sealed with a resilient plug in accordance with the invention. After the coffee is placed in the can and the can is closed, pressurized air can be injected into the coffee can with the technique of the invention.

It is among the objects of the invention to provide an improved technique for controlling and varying the internal pressure of hollow articles.

A further object of the invention is to provide an improved technique for controlling and varying the internal pressure of tennis balls.

Another object of the invention is to provide an improved technique for increasing the useful life of tennis balls.

A further object of the invention is to provide a method and apparatus for insuring uniform characteristics of tennis balls at varying atmospheric conditions.

A further object of the invention is to provide an improved technique for manufacturing and storage of tennis balls.

DESCRIPTION OF THE DRAWINGS

The foregoing and other objects and advantages of the invention will be understood more fully from the following further description thereof, with reference to the accompanying drawings wherein:

FIG. 1 is an elevation of the needle and syringe;

FIG. 2 is an enlarged elevation of the outer tip of the needle;

FIG. 3 is an enlarged side elevation in section of the needle as seen from the line 3—3 of FIG. 2;

FIG. 4 is a still further enlarged elevation of the needle and plug associated therewith;

FIG. 4A is an enlarged elevation of a modification of the needle illustrated in FIG. 4;

FIG. 5 is an illustration of the needle being applied to the wall of a tennis ball just before puncture;

FIG. 6 is an illustration of the needle fully inserted into the ball;

FIG. 7 is an illustration of the needle partly withdrawn from the ball with the plug being engaged by the wall of the ball;

FIG. 8 is an illustration of the ball after the needle has been fully withdrawn;

FIGS. 9A, 9B and 9C illustrate various plug configurations;

FIG. 10 illustrates a can having a lid which may be pressurized employing the techniques of the invention; and FIG. 11 is a partially cross-sectioned elevation of the preferred form of the invention.

DESCRIPTION OF THE PREFERRED EMBODIMENT

FIG. 1 shows one embodiment of the invention which includes a needle indicated generally by the reference character 10 which may be secured to a syringe 12. The needle has an outer tubular portion 14 which defines an outer bore 16. The outermost end of the tubular portion 14 terminates in a tapered, sharp, circular cutting edge 18. The bore 16 is blind and terminates at internal wall 20 within the needle and between the ends of the needle 10. The rearward portion 22 of the needle 10, behind the internal wall 20, has a rearwardly opening bore 24 extending therethrough and which opens through an orifice 26 formed through the side of the needle. The bores 16 and 24 may be formed in any suitable fashion. For example, the needle may be initially formed with a conventional hole through its length and a plug thereafter inserted and suitably secured to define the separate bores 16 and 24. The tubular portion 14, just rearwardly of its outer tip has a pair of cutout portions 27 which define a pair of tear drop shaped openings indicated generally at 28. Each cut out 27 is of generally concave configuration and is defined by an axially converging wall 30 and an axially diverging wall 32 (considered in an outward direction). The axially converging wall 30 extends generally along a plane which makes a relatively small angle (e.g. 20°) with the longitudinal axis of the needle and the diverging wall 32 extends along a plane which makes a more substantial angle with the axis of the needle, for example, of the order of 60°. The bore 16 is intersected by the cutout portions 27 as defined by the tear drop openings 28. As will be described more fully below, the distance from the outermost end of the cutout portion 27 (from the wall 32) to the beginning of the tapered portion 33 of the tip is less than the wall thickness of the ball or other container with which the device is to be used.

As shown in FIG. 4, the needle 10 receives an elongate plug, indicated generally at 34 in the bore 16. The plug 34 is generally circular in cross section and its diameter is somewhat less than that of the bore 16 to enable the plug 34 to be manually inserted into the bore 16. The diameter of the plug 34, however, is sufficiently large that those portions of the plug which extend along the tear drop openings 28, will protrude and be exposed slightly through the openings 28 for a purpose which will be described. The plug 34 preferably is slightly longer than the bore 16 so that when inserted fully to the internal wall 20, the outer end of the plug 34 will protrude slightly, for example, of the order of 1/16 of an inch. The plug 34 should be preferably resilient, elastic and should have a high coefficient of friction with respect to the material from which the wall through which it is to be inserted is made. For example, when the device is used in connection with a tennis ball, a plug made from rubber is suitable.

A modification of the needle shown in FIG. 4 is illustrated in FIG. 4A. In this arrangement, the needle 10A receives the plug 34 in the bore 16A. The bore 16A is cylindrical and slightly larger in diameter than the plug 34. A small helical spring 16B is positioned in the bore 16A. The spring has a length sufficient to be compressed by the plug 34 and when the container is punctured, to partially project it from the needle.

FIGS. 5–8 illustrate the manner in which the invention is employed to control the pressure in a tennis ball. As shown in FIG. 5, the needle 10, loaded with a plug 34, has been urged through the nylon covering 35 against the outside of the wall 36 of the ball with the circular cutting edge 18 just beginning to engage the wall 36. Some of the nylon 35 of the ball may become entrapped as suggested at 37. The plug 34 which is elastic and resilient compresses axially as it engages the nylon 35 and is urged toward the wall 36. As the plug 34 is axially compressed, that portion of the plug which is exposed through the tear drop openings 28 may expand somewhat as suggested in a somewhat exaggerated manner in FIG. 5 at reference character 31. The needle is continually urged against the ball to cut a cylindrical slug (suggested at 38 in FIG. 6) from the wall 36 as the needle advances through the wall. The wall 36 which typically is more resistant to compression than the material from which the plug 34 is formed may tend to enter the outer end of the tubular portion 14 which will further compress the plug 34 axially. As the needle progresses through the wall 36, the slug 38 is cut progressively until it is either severed completed from the wall 36 or may tend to remain lightly connected to the wall 36 (suggested at 38′) as by the remaining connective portion 40 as suggested in FIG. 6. At or near the end of severence of the slug 38, the resilience of the plug 34 is sufficient to urge the slug 38 or 38′ out of the tubular portion 14 of the needle at which time the plug 34 returns to its elongated, relaxed length.

It may be noted that the circular cutting edge 18 defines a diameter which is less than the outer diameter of the needle 10 and that the outer tip of the needle, as it approaches the circular cutting edge 18 is tapered at 33. The resulting puncture hole (shown at 41 in FIG. 8) formed through the wall 36 is smaller in diameter than the relaxed diameter of the plug 34 because a certain amount of stretching of the wall 36 occurs as the needle is urged through the wall. Thus, the wall 36 is cut while in a stretched configuration with the result that the ultimately formed hole (when the wall 36 later relaxes) will be smaller in diameter than that of the plug 34.

The needle 10 then is inserted fully through the wall 36 to locate the orifice 26 interiorly of the ball or other container as shown in FIG. 6. The needle 10 and ball wall 36 are sealed at this time because of the tendency of the ball wall to contract firmly about the needle 10. Depending on whether it is desired to increase or decrease the internal pressure of the ball, the syringe plunger 39 is operated to cause air to flow through the orifice either in or out of the ball. In this regard, it should be noted that when it is desired to increase the internal pressure of the ball the syringe plunger 39 is withdrawn a predetermined amount before the needle is inserted into the ball or at least just before the orifice 26 passes through the ball wall 36. Conversely, when it is desired to withdraw air from the ball and thus reduce its internal pressure, the plunger of the syringe is maintained in its fully forward position and, after the orifice 26 is located within the ball, the plunger is withdrawn a predetermined amount to withdraw air from the ball. The syringe may be marked with appropriate graduations 42 to determine just how much air is to be injected into or withdrawn from the ball to reach the desired final internal pressure.

After the interior of the ball has been re-pressurized as desired, the needle 10 is simply withdrawn from the ball. As soon as the orifice 26 has been advanced outwardly beyond the inner surface of the wall 36, the hole 41 is temporarily sealed. Withdrawal of the needle 10 is continued to the position shown at FIG. 7 in which the needle has been withdrawn sufficiently to bring the tear drop opening 28 to the ball wall 36. The sides of the plug 34 which protrude through the openings 28 engages the wall 36 through the openings 28 and as the withdrawal of the needle 10 continues, the frictional engagement between the laterally exposed plug 34 and ball wall 36 holds the plug 34 and enables the needle to be withdrawn, leaving the plug 34 in the hole 41 as shown in FIG. 8. It may be noted that as the needle is withdrawn to bring the cutout portions 27 to the wall 36, the hole 41 which was formed in the ball wall constricts about the cutout portions 27 of the needle to firmly grip the plug 34. The length of the tear drop openings 28 is such that they will expose a sufficient portion of the plug 34 so that the plug 34 will be retained by the wall of the ball until the needle is withdrawn fully. Also, the forwardmost end of the tear drop openings 28 is located in proximity to the outermost tip of the needle 10 so that the inwardly projecting portion of the plug 34 can be engaged by the innermost edge of the hole 41 in the wall 36 before the needle has been fully withdrawn. After the needle has been fully withdrawn, the wall 36 constricts tightly about and compresses the plug 34 to effect a full and complete seal as shown in FIG. 8. Typically, the end of the plug 34 will protrude outwardly from the wall 36 after the needle has been withdrawn. This additional outwardly protruding length 43 can be snipped off.

FIGS. 9A–9C illustrate other plug configurations which may be suited for use in connection with the sealing of other types of enclosed articles. For example, the plug may have an enlarged end indicated at 44 which may be of somewhat conical shape. In some instances, other shapes for the enlarged end may be employed such as the ball shape suggested at 46 or the mushroom shape suggested at 48. In each instance, however, the material and shape of the plug should be such that it can be compressed axially within the outer end of the needle 10 as it is urged through the wall 36.

The dimensions of the plug and, particularly its cross-sectional dimensions are important. It is desirable that the diameter of the plug be as small as possible thus permitting the hole formed through the ball to be as small as possible with a resulting more effective seal. I have found that when the invention is employed in connection with tennis balls, a plug 34 of the order of 1 millimeter diameter gives good results. While the length of the plug is not as critical as the diameter, it may be noted that I have found plugs of the order of 1 centimeter in length to be satisfactory for use at least with tennis balls.

The pressure which is developed interiorly of the ball by the syringe can be controlled automatically by a valve, indicated diagrammatically at 50 in FIG. 1, which opens automatically at a predetermined pressure to vent the syringe to the atmosphere when that pressure level has been reached. Various constructions of such a valve may be employed and will be apparent to those skilled in the art.

FIG. 11 illustrates the preferred embodiment of the invention as designed for use in connection with the reinflation of tennis balls. The needle 10 is similar in construction to the needles previously described as is indicated by the use of common numerals to indicate similar elements. The rearward portion 22 of the needle may be suitably secured in a collar 100, in turn secured to needle support 101. If desired, and depending on manufacturing choices, the needle 10 may be secured directly to the needle support 101. The rearwardly opening bore 24 of the needle is in fluid communication with a passage 102 that is preferably axial with respect to the needle support 101. The passage 102 is in fluid communication and is preferably axially aligned with an enlarged opening 103 at the rear end of the needle support 101. The enlarged opening 103 is designed to hold a valve assembly hereafter described.

A suitable propellent means 104 may comprise an aerosol type of can in which a fluid medium such as air or some preferably non-toxic gas is contained under pressure and is releasable by a suitable valve 105 which releases the propellent under pressure when the valve is moved axially. Such pressurized cans are in common use for such purposes as actuating fog horns. The nozzle 106 of the can is provided with a threaded exterior that is designed with a thread commonly known as a "speed thread". This speed thread is sized and shaped to readily thread into a mating opening 107 in the needle support 101. The opening 107 is in fluid communication with the passage 102. In the enlarged opening 103 a ball bearing 108 is normally held against the rear end of passage 102 by a helical spring 109, which engages the ball at one end and engages a slotted head set screw 110 at the other end. The set screw is threaded into corresponding threads at the rear end of the enlarged opening 103. Tension on the ball bearing 108 may be adjusted by suitably moving the said screw 110 to increase or decrease the pressure of spring 109.

In the operation of this unit the needle 10 is loaded with a plug and the needle is then forced into the tennis ball as hereinbefore described. With the needle properly within the tennis ball the operator then twists the can 104 relative to the needle support 101 so that the pressurized medium in the can 104 is emitted through the nozzle 106 into passage 102. The air or other fluid medium used then enters the tennis ball through the opening or hole 26 until a desired pressure is reached. The desired pressure is controlled by appropriate adjustment of said screw 110. Thus, if the said screw is properly set and a desired pressure of fifteen pounds psi is chosen, air will stop entering the tennis ball at this selected pressure. The pressure will then act against spring 109 and ball bearing 108 and the air will then start to be emitted through the hole 111 in the set screw 110. At this point the operator will remove the needle from the ball allowing the plug to engage the ball in the hole formed by the needle.

The embodiment described in FIG. 11 is designed so that ready adjustments may be made to the set screw 110 for purposes of selecting the appropriate pressure. In addition, the aerosol can or container 104 may readily be replaced when the can is exhausted.

While the invention has been illustrated thus far with regard to the reconditioning of tennis balls by increasing or decreasing their internal pressure, it should be understood that the invention is not limited solely to such use. For example, the invention may be employed in connection with the manufacture of tennis balls. By employing the present invention, the balls can be assembled at atmospheric pressure, thus avoiding the necessity of employing special equipment and techniques to seal and isolate the ball in a pressurized environment during its assembly. After the ball has been assembled under atmospheric conditions, it can then be pressurized by injecting the compressed air into the ball in the manner described above. Additionally, it should be noted that while the invention has been described, for purposes of illustration, as employing a syringe for forcing the air into or withdrawing the air from the ball or other hollow container, other sources of compressed air or sources for withdrawing air may be employed.

Additionally, the invention may be employed with hollow sealed articles other than balls. It may be employed to pressurize the interior of a can after the can has been sealed. For example, it may be employed in connection with cans for tennis balls, coffee cans, etc. To this end, a portion of the container is made from a puncturable material and through which a needle may be inserted in accordance with the invention. As shown in FIG. 10, a tennis ball can 52 has a lid 54 which is made so that it can be punctured and then sealed after compressed air has been introduced into the can.

It should be understood that the foregoing description of the invention is intended merely to be illustrative thereof and that other embodiments and modifications may be apparent to those skilled in the art without departing from its spirit.

I claim:

1. A device for pressurizing a sealed, puncturable hollow article comprising:

a needle for puncturing the hollow article;

means formed on the needle for carrying a sealing plug therewith into the interior of the hollow article;

the needle including means for enabling a fluid medium to flow between the interior and exterior of the article when the needle is inserted into the article; and means responsive to retraction of the needle from the article to cause the plug to remain within and seal the puncture formed by the needle.

2. A device as set forth in claim 1 including means for introducing said fluid medium into said needle comprising a closed container having said fluid medium under pressure.

3. A device as set forth in claim 2 including a needle support, said needle support having a passage therethrough interconnecting said container and said needle for passage of said fluid medium from said container to and through said needle.

4. A device as set forth in claim 3 including relief valve means in said needle support between said passage and the wall of said needle support whereby the fluid medium from said container will escape through said relief valve when the pressure in an article in which said needle has been inserted reaches a preselected level.

5. A device as set forth in claim 1 wherein said means responsive to retraction of said needle from the article comprises means forming a tubular end for receiving an elongated plug and a helical spring in said tubular end with one end of said spring engaging the end wall of said tubular end and the other end of said spring adapted to engage and be compressed by a plug inserted in said tubular end.

6. A device as set forth in claim 1 wherein means responsive to retraction of said needle from the article comprises:

a plug formed from a resilient, axially compressible material, means forming a bore for receiving said plug, said bore extending from the free end of the needle axially along its length and terminating at an end wall, said bore having a length shorter than the uncompressed length of said plug.

7. A device for pressurizing a sealed, puncturable hollow article comprising:

a needle having a tubular end receptive to an elongate plug;

the tubular end of the needle having an opening formed in its side to expose an intermediate portion of an elongate plug contained in the tubular portion; and the needle having an air passage extending through the outer end thereof, the air passage opening through an orifice in the side of the needle at a location behind the tubular end of the needle.

8. A device as defined in claim 7 further comprising:

the outermost tip of the needle defining a continuous sharp cutting edge.

9. A device as defined in claim 8 further comprising:

the end of the needle, being tapered slightly toward the cutting edge, the opening defined by the cutting edge being smaller than the cross sectional dimensions of the tubular end of the needle.

10. A device as defined in claim 7 further comprising:

means defining at least one elongate opening extending along the side of the tubular portion of the needle through which the plug may be exposed.

11. A device as defined in claim 10 wherein there are two such elongate openings on opposite sides of the tubular portion of the needle.

12. A device as defined in claim 10 wherein the openings are of generally tear drop shape.

13. A device as defined in claim 12 wherein the opening is defined by a concave cut out having a first rearward portion which converges forwardly toward the longitudinal axis of the needle and a second portion which diverges forwardly from the axis of the needle.

14. A device as defined in claim 7 further comprising:

a syringe connected to the rear end of the needle.

15. A device as defined in claim 7 further comprising, in combination:

said plug being disposed within said tube, the plug being long enough to extend from the rear end of the tube at least beyond the cut out portion in the side of the tube.

16. A device as defined in claim 12 wherein the plug is formed from a resilient, elastic material and is sufficiently long to protrude slightly beyond the end of the tube when relaxed, the plug being axially compressible within the tubular portion of the needle.

17. A plug as defined in claim 16 wherein one end of the plug is of enlarged cross sectional dimensions.

18. A method for varying the internal pressure of a sealed, hollow article, comprising:

providing a needle having means at one end for carrying a plug and an air passage at its other end, the air passage terminating in an orifice located between the ends of the needle;

puncturing the article with the needle and inserting the needle through the article to locate the plug interiorly of the article and to locate the orifice interiorly of the article;

causing air to flow selectively to or from the interior of the article through the orifice; and thereafter withdrawing the needle and causing the plug to frictionally engage the punctured portion of the article so that upon continued withdrawal of the needle the plug will remain engaged by the article.

19. A method as defined in claim 18 further comprising:

while inserting the needle through the portion of the article, simultaneously causing that portion of the article to be stretched thereby to puncture the article while in a stretched condition.

20. A method for varying the internal pressure of a sealed, hollow article, at least a portion of which is formed from a resilient, flexible material comprising:

piercing the article to form a hole therethrough with a diameter in the order of magnitude of a millimeter and at substantially the same time introducing into the article a plug having a diameter greater than that of said hole and a length at least equal to the length of said hole, thereafter introducing a fluid medium into said article to increase the pressure within said article, and thereafter moving said plug into said hole and allowing said material to resiliently engage said plug whereby said hole is sealed.

21. A method as set forth in claim 20 wherein said fluid medium is introduced into said article from a closed pressurized container.

22. In a method of inflating a tennis ball the step of coring a cylindrical segment from the wall of said ball with said segment having a diameter in the order of one millimeter, removing the core from the wall, introducing air into said ball through the hole formed in the wall and thereafter sealing the hole formed by the removal of said core.

23. A method as set forth in claim 22 wherein said core is introduced into the interior of said ball after it is cored and before air is introduced into said ball through said hole.

* * * * *